US005388314A

United States Patent [19]

Vella

[11] Patent Number: 5,388,314

[45] Date of Patent: Feb. 14, 1995

[54] POOL COVER FASTENER

[76] Inventor: Anthony Vella, 34 Olivia Dr., Rochester, N.Y. 14626

[21] Appl. No.: 973,420

[22] Filed: Nov. 9, 1992

[51] Int. Cl.[6] ..... B42F 1/02

[52] U.S. Cl. ..... 24/555; 4/503; 24/462; 24/563

[58] Field of Search ..... 24/563, 462, 460, 67.9, 24/555, 561, 562, 564, 545; 52/3, 169.7; 4/503, 498, 499, 504

[56] References Cited

U.S. PATENT DOCUMENTS

| | | | |
|---|---|---|---|
| Re. 30,774 | 10/1981 | Dahlbeck et al. | 4/503 X |
| 487,959 | 12/1892 | McDonald | 24/67.9 |
| 1,274,344 | 7/1918 | Staub | 24/561 |
| 1,528,454 | 3/1925 | Taggart et al. | 24/562 X |
| 1,675,286 | 6/1928 | Van Valkenburg | 24/563 X |
| 1,695,290 | 12/1928 | Leff | 24/561 X |
| 2,522,911 | 9/1950 | Weaver | 24/562 X |
| 2,599,447 | 6/1952 | Hall | 24/561 X |
| 2,650,596 | 9/1953 | Portaro | 24/563 X |
| 3,086,264 | 4/1963 | Tindall | 24/562 X |
| 3,797,076 | 3/1974 | Watkin | 24/562 |
| 4,011,607 | 3/1977 | Davidoff | 4/503 |
| 4,847,925 | 7/1989 | Perry | 4/503 X |

FOREIGN PATENT DOCUMENTS

| | | | |
|---|---|---|---|
| 935347 | 10/1973 | Canada | 4/499 |
| 0136714 | 1/1903 | Germany | 24/561 |
| 108392 | 9/1943 | Sweden | 24/67.9 |

*Primary Examiner*—Lloyd A. Gall

*Attorney, Agent, or Firm*—Howard J. Greenwald

[57] ABSTRACT

An integral fastener for securing a pool cover to the top rail of an above-ground pool is disclosed. The fastener is comprised of a first leg, a second leg, a first downwardly-extending, diverging lip connected to said first leg, and a second downwardly-extending diverging lip connected to said second leg.

The first leg and the second leg are partially contiguous with each other and form a closed cavity which is defined by a continuous surface consisting of a first substantially linear wall, a substantially concave inner wall, a substantially convex wall, and a second substantially linear wall.

9 Claims, 1 Drawing Sheet

POOL COVER FASTENER

FIELD OF THE INVENTION

An integral fastener for securing a pool cover to the top rail of an above-ground pool.

BACKGROUND OF THE INVENTION

Above ground pools provide an inexpensive and healthy means of recreation for millions of families. During the off-season, however, these pools must be covered to prevent damage to their liners by the entry of falling debris and to prevent the contamination of water in the pool by leaves and dirt.

Many of the above-ground pools are relatively large, extending up to about twenty-eight feet in diameter; and they often require large and heavy pool covers to protect them.

One common means of securing such pool covers to the pools is to fasten selected portions of such covers to the top rails of the pools. However, applicant is not aware of any fastener which can be used for this purpose which can be removably attached to the top rail of the pool, which is durable, reliable, resistant to weathering, and inexpensive.

It is an object of this invention to provide a pool clip which can readily be attached to the top rail of a pool to provide secure fastening of a pool cover.

It is another object of this invention to provide a pool clip which, after it has been attached to the top rail of a pool, can readily be removed.

It is another object of this invention to provide a pool clip whose physical properties do not change substantially with time.

SUMMARY OF THE INVENTION

In accordance with this invention, there is provided an integral pool cover fastener comprised of a first leg, a second leg, first and second lips which extend divergingly from said first and second legs, and a cavity between said first and second legs which is preferably comprised of a first substantially linear portion, a convex-concave arcuate portion, and a second substantially linear portion.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
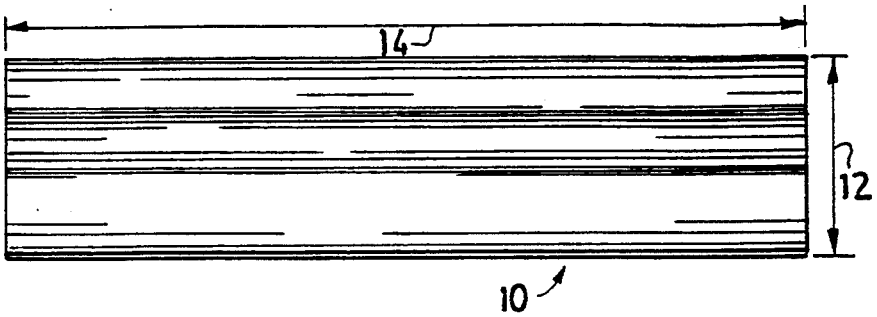
FIG. 1 is a front view of one embodiment of the pool clip of this invention.

FIG. 1 is a front view of one preferred embodiment of pool clip 10. Referring to FIG. 1, it will be seen that pool clip 10 preferably is an integral structure. Although pool clip 10 may be made out of metal, elastomeric material (such as rubber), and other materials, in one embodiment, it is preferred that such pool clip 10 consist essentially of plastic. In another embodiment, it is preferred that pool clip 10 consist essentially of a composite material.

In one preferred embodiment, pool clip 10 consists essentially of a rigid plastic and, preferably, an ultraviolet light stablilizer. As is known to those skilled in the art, many polymeric materials are inherently rigid; and plasticizers are added to soften and flexibilize these polymers. Thus, by way of illustration, plasticizers are often used with polyvinyl chloride, cellulosic polymers, nylon polymers, polyvinyl acetate polymers, urethanes, and acrylics. These plasticizers (pages 184–186) and these polymers (pages 122–125, 17–18, 23–32 11 etc.) are well known to those skilled in the art end are described in, e.g., the "Modern Plastics Encyclopedia '92," Modern Plastics Mid-October 1991 edition (Modern Plastics, Highstown, N.J.).

In one preferred embodiment, pool clip 10 consists essentially of unplasticized or substantially unplasticized polyvinyl chloride. By way of illustration and not limitation, one may use a "GEON" polyvinyl chloride material. These "GEON" polyvinyl chloride polymers are sold by the B. F. Goodrich Company, Chemical Group, 6100 Oak Tree Boulevard, Cleveland, Ohio 44134.

In one preferred aspect of this embodiment, "GEON 8700A" is used as the polyvinyl chloride material. This material is preferably formed into pool clip 10 by extrusion.

In one preferred embodiment, pool clip 10 is comprised of an effective amount (preferably from about 0.5 to about 2.0 weight percent, by total weight) of an ultraviolet light stabilizer. As is known to those skilled in the art, ultraviolet light stabilization can be achieved by a reduction in the rate of photo-initiation and reduction in the kinetic chain length of the propagation stage of the photo-oxidation mechanism. See, e.g., pages 192–196 of said "Modern Plastics Encyclopedia," supra.

Pool clip 10 also may optionally be comprised of from about 1.0 to about 2.0 weight percent of a colorant; see, e.g., pages 154–159 of said "Modern Plastics Encyclopedia."

Other conventional additives also may be used in the system. In one embodiment, it is preferred that at least about 90 weight percent of the pool clip 10 be comprised of the polymeric structural material (such as polyvinyl chloride) and that no more than about 10 weight percent of the pool clip be comprised of one or more additives.

Referring again to FIG. 1, it will be seen that pool clip 10 preferably has a height 12 of from about 1.2 inches to about 3.0 inches. In an even more preferred embodiment, pool clip 10 has a height 12 of from about 1.3 to about 2.0 inches. In yet another embodiment, pool clip 10 has a height 12 of from about 1.3 to about 1.6 inches.

The pool clip 10 also preferably has a length 14 of at least about 1.0 inch, and, more preferably, at least about 3.0 inches. In one embodiment, the length 14 is at least about 5.0 inches. In another embodiment, where pool clip 10 extends substantially the hole length of a section of the pool rail, length 14 is at least 48 inches.

Figure 2:
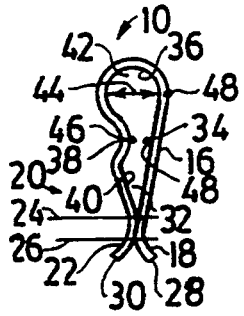
FIG. 2 is a side view of the pool clip of FIG. 1.

FIG. 2 is a side view of pool clip 10. Referring to FIG. 2, it will be seen that pool clip 10 is comprised of first leg 16, first downwardly extending lip 18, second leg 20, and second downwardly-extending lip 22.

Referring to FIG. 2, it will be seen that legs 16 and 20 are contiguous with each other from about point 24 to about point 26. Thereafter, lips 18 and 22 extend divergingly away from each other from point 26 until end 28 of lip 18 and end 30 of lip 22.

The ends 28 and 30 of lips 18 and 22 must be at least about 0.1 inches apart from each other. It is preferred that ends 28 and 30 are at least about 0.2 inches apart from each other. In one embodiment, ends 28 and 30 are at least about 0.25 inches apart from each other.

Referring again to FIG. 2, it will be seen that, in the preferred embodiment depicted therein, legs 16 and 20 define a closed cavity 32 which is defined by a continuous surface consisting of substantially linear inner wall 34, substantially concave inner wall 36, substantially convex inner wall 38, and substantially linear inner wall 40.

The proximal end 42 of closed cavity 32 preferably contains an arcuate surface, which is defined by inner wall 36, which has a maximum cross-sectional dimension 44 which is at least about 0.15 inches and, more preferably, at least about 0.3 inches.

By comparison, the inwardly-extending inner wall 38 forms a depression whose innermost point 46 is from about 0.06 to about 0.25 inches from point 48 on the opposing inner wall of leg 16.

The minimum distance 44 between the opposing walls which form the uppermost concave section 36 must be larger than the distance between points 46 and 48. Thus, the width of the concave section 36 must be at least about 0.1 inches greater than the distance between points 46 and 48. It is preferred that the width of the concave section 36 be at least about 0.2 inches greater than the distance between points 46 and 48.

Referring again to FIG. 2, it will be seen that substantially linear inner wall 34 extends from about point 24 to about point 48. It is preferred that such substantially linear inner wall 34 have a length of at least about 0.5 inches and, more preferably, at least about 1.0 inch.

In one embodiment, pool clip 10 is comprised of walls with a substantially uniform thickness. In one aspect of this embodiment, the walls forming pool clip 10 have a thickness of from about 0.05 to about 0.6 inches.

A.S.T.M. Standard Test D-638, "Test Method for the Tensile Properties of Plastics," may be used to determine the amount of force required to separate lips 18 and 22 so that the portion of clip 10 wherein legs 16 and 20 are contiguous (between points 24 and 26) are separated so that legs 16 and 20 are at least 0.25 inches apart at this section. As is known to those skilled in the art, this determination may be made on a Universal Testing Machine. It is preferred that from about 2 to about 50 pounds of force, applied to lips 18 and 22, be required to separate legs 16 and 20 by at least 0.25 inches.

Pool clip 10 is substantially elastic. When its legs 16 and 20 are separated at least 0.25 inches by a force of from about 2 to about 50 pounds, and the separating force is thereafter removed, the legs 16 and 20 will tend to return to the closed position with a force of from about 2 to about 50 pounds.

Pool clip 10 may be produced by conventional forming means. Thus, e.g., it could be made by injection molding, by extrusion, by compression and transfer molding, by vacuum forming, by heat forming, and the like. These and other suitable forming techniques are described in Joel Frados' "Plastics Engineering Handbook" (Van Nostrand Reinhold Company, New York, N.Y., 1976).

In one preferred embodiment, pool clip 10 is made by an extrusion molding technique in which plastic resin is introduced internally to a heated cylinder containing an internal auger by means of a hopper arranged over an opening in the end of a cylinder (often referred to as the extruder's barrel and screw). By a suitable arrangement of motor and gears, the screw is caused to turn at a selected, required speed. By an arrangement of heaters on the barrel and heater controllers, the barrel is heated to and maintained at the precise, required temperature. The resin introduced via the hopper traverses the length of the barrel while being plasticated (mixed and melted) into a plastic fluid and pressurized to 500–3,000 p.s.i. under the viscous-drag pumping phenomenon of the screw and barrel. Upon exit of the screw and barrel, the pressurized plastic resin enters the extrusion die where, as it flows toward the die's exit orifice, it is gradually formed into the required pool-clip shape determined by the precise dimension of the exit orifice.

After exiting the die, the extrudate is soft and malleable whereupon it is caught and captured by cooling fixtures and implements while at the same time it is being stretched and pulled through the cooling fixtures by a pulling machine located some 15 feet or so downstream. The pulling machine is set at a speed controllable arrangement of gripping rollers or belts that, while continuously gripping the cold extrudate, simultaneously pull it along at a precise speed. While being pulled, stretched, captured, shaped, and further formed by the coordinated effect of the puller and cooling fixtures, the hot, soft, die-exit extrudate is reduced in size to the precise dimension required by the pool-clip profile.

After exiting the puller, the cold pool-clip profile is cut into lengths by a saw.

Figure 3:
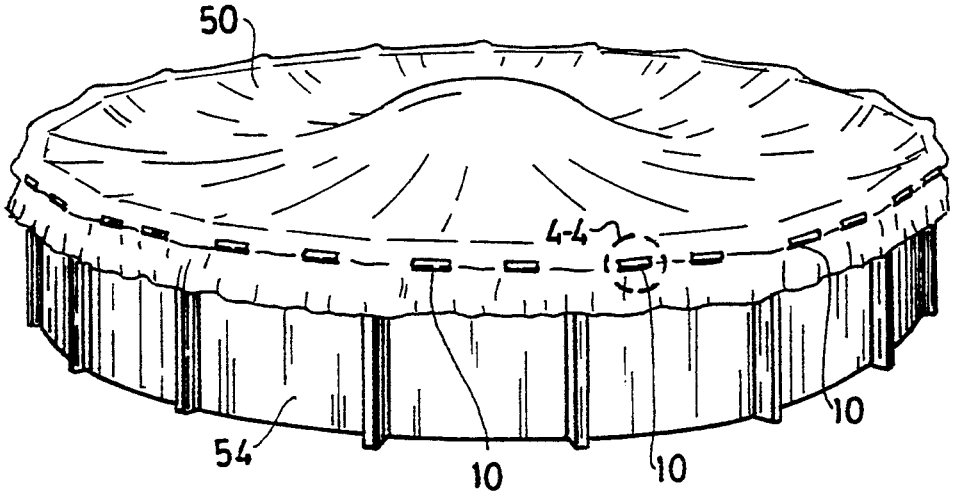
FIG. 3 is a perspective view of a pool cover secured in place by a multiplicity of the pool clips of FIG. 1.
Figure 4:
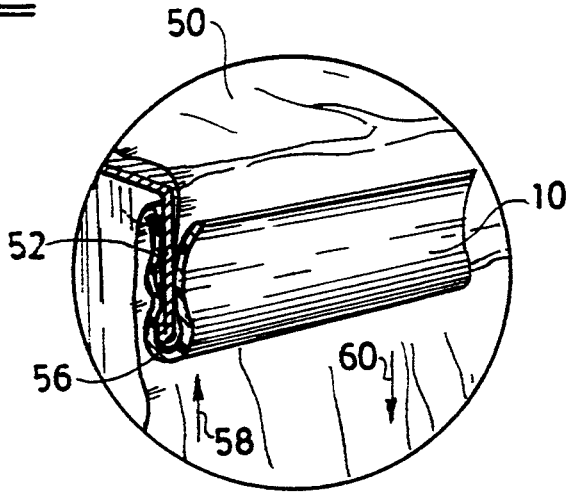
FIG. 4 is a perspective view of one of the pool clips of FIG. 3 securing a portion of the pool cover of FIG. 3.

FIGS. 3 and 4 illustrate the use of pool clip 10 to secure a pool cover 50 to the downwardly-extending top rail 52 of pool 54.

Referring to FIG. 4, it will be seen that top rail 52 is substantially L-shaped, with a downwardly-extending portion terminating in arcuate end section 56. In the process of this invention, pool cover 50 is first tucked around arcuate end section 56 so that a portion 58 of the pool cover 50 is in back of the top rail 52. Thereafter, pool clip 10 is pushed in the direction of arrow 58 to cause legs 16 and 20 to separate and to allow pool clip 10 to compress a first portion of pool cover 50, the front wall of top rail 52, the back wall of top rail 52, and a second portion of pool cover 50.

In general, from about 10 to about 20 pounds of force must be exerted in the direction of arrow 58 to push pool clip 10 into place. A similar amount of force must be exerted in the direction of arrow 60 when the pool clip is being pulled away from top rail 52 in order to disengage the pool clip.

A sufficient number of pool clips 10 should be utilized so that pool cover 50 is firmly held in place. In one embodiment, pool clips 10 are substantially equally disposed around the perimeter of pool 54, and the average distance between the ends of adjacent pool clips 10 does not exceed about 12 inches.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. An integral fastener for securing a pool cover to the top rail of an above-ground pool, wherein said fastener is comprised of a first leg, a second leg, a first downwardly-extending, diverging lip connected to said first leg, and a second downwardly-extending diverging lip connected to said second leg, wherein:

(a) said fastener has a height of from about 1.2 to about 3.0 inches and a length of at least about 1.0 inch;

(b) said first leg and said second leg are partially contiguous with each other and form a closed cavity which is defined by a continuous surface consisting of a first substantially linear wall, a substantially concave inner wall, a substantially convex wall, and a second substantially linear wall, wherein:

1. said closed cavity is comprised of an upper-most concave section with a width of at least about 0.15 inches,
2. said closed cavity is comprised of an intermediate convex section with a minimum width of from about 0.06 to about 0.25 inches,
3. the width of said uppermost concave section exceeds the minimum width of said intermediate convex section by at least about 0.1 inches;

(c) said first substantially linear wall has a length of at least about 0.5 inches;

(d) said first lip is comprised of a first end, said second lip is comprised of a second end, and the distance between said first end and said second end when said first leg and said second leg are partially contiguous with each other is at least about 0.1 inches; and (e) when said first leg and said second leg are partially contiguous with each other, a force of from about 2 to about 50 pounds is required to separate said first leg and said second leg so that they are at least about 0.25 inches apart.

2. The fastener as recited in claim 1, wherein said fastener is comprised of at least about 90 weight percent of plastic.

3. The fastener as recited in claim 2, wherein said fastener is comprised of from about 0.5 to about 2.0 weight percent of ultraviolet light stabilizer.

4. The fastener as recited in claim 3, wherein said fastener is comprised of from about 1 to about 2 weight percent of colorant.

5. The fastener as recited in claim 2, wherein said plastic is polyvinyl chloride.

6. The fastener as recited in claim 5, wherein said fastener has a height of from about 1.3 to about 2.0 inches and a length of at least about 3.0 inches.

7. The fastener as recited in claim 6, wherein said first end and said second end are spaced at least about 0.2 inches apart from each other.

8. The fastener as recited in claim 7, wherein said uppermost concave section has a width of at least about 0.3 inches.

9. The fastener as recited in claim 8, wherein the width of said uppermost concave section exceeds the minimum width of said intermediate convex section by at least about 0.2 inches.

* * * * *